US007095190B2

(12) United States Patent
Sieber

(10) Patent No.: US 7,095,190 B2
(45) Date of Patent: Aug. 22, 2006

(54) ARRANGEMENT FOR OPERATING A CONTACT ROLLER AND ASSOCIATED METHOD FOR OPERATING A CONTACT ROLLER

(75) Inventor: Bernd Sieber, Siegsdorf (DE)

(73) Assignee: Bruckner Maschinenbau GmbH, Siegsdorf (DE)

( * ) Notice: Subject to any disclaimer, the term of this patent is extended or adjusted under 35 U.S.C. 154(b) by 111 days.

(21) Appl. No.: 10/487,776

(22) PCT Filed: Aug. 15, 2002

(86) PCT No.: PCT/EP02/09149

§ 371 (c)(1),
(2), (4) Date: Feb. 26, 2004

(87) PCT Pub. No.: WO03/022720

PCT Pub. Date: Mar. 20, 2003

(65) Prior Publication Data

US 2004/0245859 A1 Dec. 9, 2004

(30) Foreign Application Priority Data

Sep. 6, 2001 (DE) ..... 201 14 750 U

(51) Int. Cl.
*H02K 41/00* (2006.01)

(52) U.S. Cl. ..... 318/135; 242/547

(58) Field of Classification Search ..... 242/541.4, 242/541.5, 547; 318/135
See application file for complete search history.

(56) References Cited

U.S. PATENT DOCUMENTS 5,862,887 A * 1/1999 Swaybill et al. ..... 187/313
6,036,137 A * 3/2000 Myren ..... 242/541.7

FOREIGN PATENT DOCUMENTS

| | | |
|---|---|---|
| DE | 26 13 453 | 10/1977 |
| DE | 76 09 748 | 9/1978 |
| DE | 33 35 713 | 4/1985 |
| DE | 33 47 733 | 11/1985 |
| DE | 36 27 463 | 2/1988 |
| DE | 41 03 799 | 8/1992 |
| DE | 196 22 699 | 12/1997 |
| DE | 196 29 205 | 1/1998 |
| DE | 196 52 769 | 6/1998 |
| DE | 198 07 897 | 8/1999 |
| DE | 697 03 423 | 3/2001 |
| DE | 698 00 627 | 11/2001 |
| EP | 0 195 850 | 10/1986 |
| EP | 0 399 370 | 11/1990 |
| EP | 0 819 638 | 1/1998 |
| JP | 2000255849 | 9/2000 |
| WO | WO 00/55078 | 9/2000 |

* cited by examiner

*Primary Examiner*—Karl Tamai
*Assistant Examiner*—Judson H. Jones
(74) *Attorney, Agent, or Firm*—Nixon & Vanderhye P.C.

(57) ABSTRACT

An improved arrangement for operating a contact roller (7) and an associated method, characterized inter alia by the following features: a linear motor drive (14) is allocated to the contact roller (7) in order to change positon; a force adjustment device (400) is provided for the linear motor drive (14); a suitable sensor is also provied in order to determine speed or acceleration.

22 Claims, 1 Drawing Sheet

Figure 1:
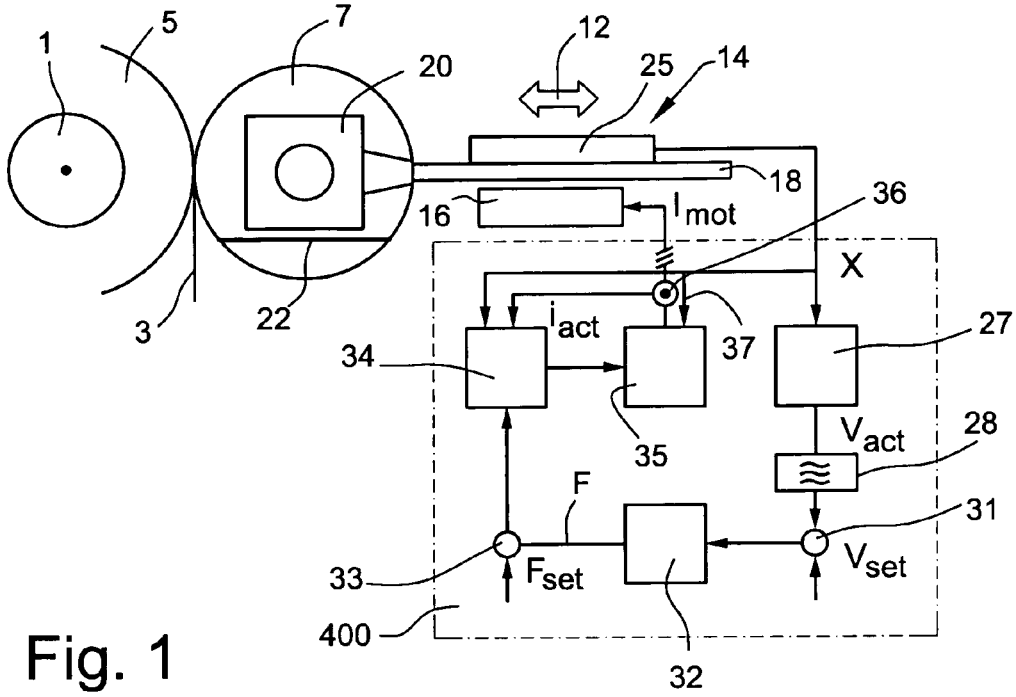

ARRANGEMENT FOR OPERATING A CONTACT ROLLER AND ASSOCIATED METHOD FOR OPERATING A CONTACT ROLLER

This application is the US national phase of international application PCT/EP02/09149 filed 15 Aug. 2002 which designated the U.S. and claims benefit of DE 201 14 750.5, dated 6 Sep. 2001, the entire content of which is hereby incorporated by reference.

The invention relates to an arrangement for operating a contact roller and a process for operating such a contact roller.

Especially in the manufacture of plastic film are the lengths of plastic film which have been stretched conventionally in a stretching system in the transverse and lengthwise direction ultimately rolled onto a take-up roller. During the rolling process of course the diameter of the rolled bales becomes increasingly larger. A contact roller which presses with a preselectable pressure the film layer which is the outermost at the time against the bale which has been rolled until that time is in contact with the take-up roller and the rolled bale.

Of course, during the rolling process the bale which is being rolled becomes at least slightly unround, so that between the contact roller and the bale which is being rolled vibrations can form. They would lead to a change of the contact pressure forces, by which the rolling process is furthermore adversely affected.

In the take-up means generally known in the prior art, driving takes place in order to keep the contact roller in contact with the length of film of the take-up roller, which length is the outermost at the time, in two stages. Within the framework of the first stage extensive movement of the contact roller takes place depending on the increasing roll diameter and on the initial and starting situation in the take-up of a new roll over the entire adjustment range, therefore until the bale which is being rolled is completely wound up. The second stage for the adjustment range acts in series to the first stage and is designed to cover only small distances and magnitudes of for example 20 to 30 mm, therefore to carry out fine matching of the relative position of the contact roller relative to the take-up roller in this range. The actual contact pressure force on the bale which is being rolled is often produced in this stage by pneumatic cylinders. By means of lever mechanisms and hydraulic dampers therefore the forces for pressing against the contact roller can be matched to the bale which is being rolled. But the disadvantage here is that for multipart arrangements in the articulation sites, play which increases with the length of operation is produced and is expressed as unsteadiness over the course of movement.

A process and a device for damping of contact vibrations has already been suggested according to DE 196 52 768 A1. The prior publication describes a process for damping of contact vibrations of rotating rollers in a paper-making machine, the rollers being held in supports on the face side and in doing so at least two rollers forming a nip with one another. In order to minimize the contact vibrations of the contact roller there is active damping, active excitation in the form of a phase-shifted countervibration being intended to act from the outside direction or indirectly on at least one bearing point of the roller. This can take place by actuators which engage the bearing points of the rollers and which can also work electromagnetically. The excitation is detected by sensors, the principle and arrangement of which however are not otherwise described.

A process and a device for rolling a web of paper onto a roller with active vibration damping was also disclosed among others in EP 0 819 638 A3. In a first arrangement damping takes place by coupling of additional masses via springs, by which detuning of the resonant frequency is enabled. In a second arrangement the balancing of the additional masses and springs is designed such that vibration takes place in phase opposition to the exciting vibration in order to thus compensate for the unwanted vibration overall. Gas cylinders are used as the actuators here.

The object of this invention is conversely to devise an improved arrangement and an improved process for operating a contact roller, i.e. especially for a length of plastic film and/or an improved take-up means or take-up arrangement which comprises in addition to a take-up roller a contact roller which applies pressure as free of vibration as possible, with force setpoints which are stipulated to be as optimum as possible, to the layer of the length of film which is to be rolled, which layer is the outermost at the time.

The object is achieved as claimed in the invention with respect to the arrangement according to the features given in claim 1 and with respect to the process according to the features given in claim 14. Advantageous embodiments are given in the dependent claims.

According to this invention a new approach is suggested which offers advantages which are clear in practice.

In contrast to the generic prior art as claimed in DE 196 52 769 A1 a damping means in the sense of classical position control is implemented not only in a general manner, but depending on the physical quantities which can be specifically determined or measured for purposes of signal superposition for modification of the contact pressure of the contact roller, countercontrol for a linear motor drive which runs the contact roller is proposed in order to maintain improved contact pressure during the entire rolling process. As claimed in the invention therefore the contact pressure force, i.e. in general the force produced by the linear motor, is changed depending on the vibration state in order to ensure application of contact pressure which is as uniform as possible. As claimed in the invention it is provided that for a contact roller which can be adjusted by a linear motor drive the adjustable path of a secondary part which is the current path at the time relative to a primary part or vice versa is detected via a sensor means. This is because, in the case of a generated vibration of the contact roller, the secondary part would thus traverse a relative path compared to the stationary primary part. From this the control means produces a speed value which is compared to a setpoint and the difference is sent to a controller in order to produce a force quantity at the output of the control means. This force quantity is then added to the setpoint force in order to supply the result to a force controller. In doing so, ultimately the magnitude of the output current for the linear motor is produced in order to produce the modified force quantity and thus the modified contact pressure force.

It has proven especially effective as claimed in the invention that the linear motor drive can perform a double function. The linear motor drive is ultimately used as a damping means for the contact roller, but likewise also as a contact pressure element for producing the optimum contact pressure force. This offers distinct advantages over the entire prior art.

Furthermore as claimed in the invention there is no actual value control or position control, but control of the transfer of force. This dynamic system compared to position control has the important advantage that even with detection of a vibration motion of the contact roller which is not 100% optimum there is a self-matching possibility.

The advantages of the approach as claimed in the invention can be briefly characterized as follows:

- As claimed in the invention the pressure or contact force and the damping force are applied in an actuator;
- the contact roller can be adjusted by a single arrangement in the near range and the far range;
- the action of the arrangement is the same on both bearing sides of the contact roller;
- no additional disadvantageous play occurs as claimed in the invention;
- the force of the linear motor remains constant and is thus independent of the adjustment path;
- the pressure and contact force is adjustable within wide limits with small time constants;
- damping is adjustable within wide limits with small time constants;
- effective damping is also possible for short strokes and adjustment paths;
- as claimed in the invention high control dynamics can be accomplished;
- adaptive adjustment of the contact pressure force is possible;
- adaptive adjustment of damping is possible;
- moreover the use of existing knowledge is possible, as is filed for example in data memories in order to carry out further optimization which goes beyond currently measured values;
- self-learning systems can be implemented;
- a combination of near and far adjustment can be implemented; and
- the entire arrangement can be implemented with high stiffness.

The invention is detailed below using embodiments.

Figure 2:
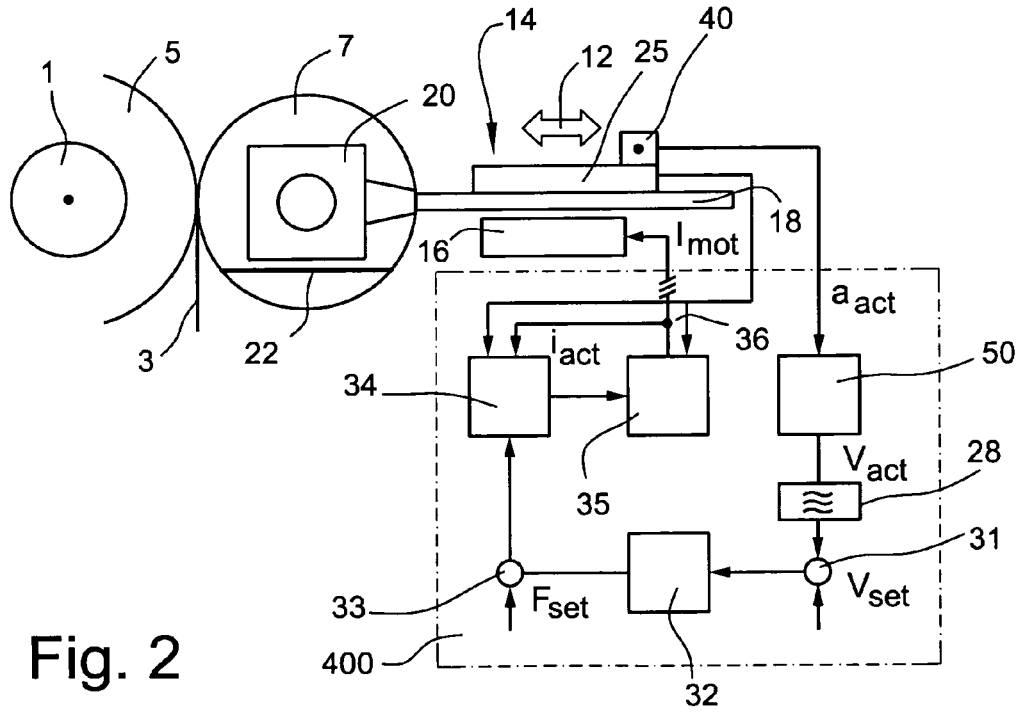

FIG. 1 shows a first embodiment of the arrangement as claimed in the invention; and FIG. 2 shows an embodiment modified from FIG. 1.

FIG. 1 shows a first arrangement with sensors, actuators and a control means for active damping of a contact roller. FIG. 1 shows as an extract a take-up roller 1 on which a length 3, which is also called a length 3 of film below, is to be taken up. With an increasing take-up process the diameter of the bale which is being rolled becomes increasingly larger. One contact roller 7 is used to produce a good take-up result and presses with its peripheral surface on the outermost length of the take-up roller 1 or the bale 5 which is being rolled. To do this the contact roller 7 must be adjustable according to the arrow 12 to the take-up roller 1 which is generally supported to be stationary, matched to the roll diameter which becomes increasingly larger during the take-up process.

Here the actual contact pressure force on the bale 5 which is being rolled is applied for example by a linear motor drive 14 which according to the embodiment shown comprises a stationary primary part 16 and a secondary part 18 which can be adjusted relative to it according to the double arrow 12. The secondary part 18 at least indirectly engages the bearing points 20 of the contact roller 7 so that the contact roller 20 can be adjusted by means of the linear motor drive 14 or its adjustable secondary part 18 along the guide means 22 toward the take-up roller 1 or away from it.

The path of the secondary part 18 is ultimately detected by a length measurement system 25 which is connected to the secondary part 18.

In a downstream control means 400 a differentiator 27 which is provided in the control means 400 forms the actual speed $v_{act}$ from the path x of the length measurement system 25 which can be moved along with the secondary part 18, compares it to the setpoint speed $v_{set}$ in an adder 31 which is connected downstream of the differentiator 27. Preferably there is furthermore a filter means, especially a highpass filter 28 which according to the embodiment as shown in FIG. 1 is downstream of the differentiator 27 and upstream of the adder 31. In any case in one simplified embodiment the highpass filter 28 can be abandoned so that the output of the differentiator 27 is directly connected to the input of the adder 31.

In a controller 32 which is downstream of the adder 31 the difference formed from the actual and setpoint speed according to definable or preselectable scaling produces a force quantity which is at the output of the controller 32. This force quantity F is then added to a likewise definable setpoint force $F_{set}$ in a downstream adder 33.

This result is then supplied to a force controller 34. But at least one value for the actual current $i_{act}$ from the current detection 36 is supplied as an input quantity to the so-called force controller 34 so that the force controller 34 can also determine a setpoint for the force for vector control 35 with consideration of the actual current value $i_{act}$. In addition, if necessary a value for the path x, i.e. for the path of adjustment of the movable primary part 16 relative to the secondary part 18, as the input quantity can be supplied to the force controller 34, as is indicated by reference number 37.

The vector control 35 then conditions the signals and converts the phases correctly such that the output current $i_{mot}$ is fed into the primary part 16 of the linear motor 14 in order to carry out the optimally desired compensation motion for the bearings of the contact roller 7 and thus for the contact roller 7 itself.

Therefore, by superposition of the contact force with a fraction which is proportional to the speed of the bearing points 20 of the contact roller 7 the arrangement causes an increase or decrease of the force on the movable secondary part 18 and thus on the line of contact between the contact roller 7 and the take-up roller 1 and the bale 5 which is to be rolled onto it preferably such that the relative motion between the two compared to an uncorrected state is minimized or even becomes zero or at least tends to zero, so that therefore unwanted vibrations (relative vibrations or changes of distance) are avoided.

It furthermore follows from the explained structure that the manner of operation and the action of the stationary primary part 16 and the function and the action of the secondary part 18 can also be interchanged.

Reference is made to FIG. 2 below in which the same reference numbers label the same components. If not otherwise described, the manner of operation and action in the embodiment shown in FIG. 2 is comparable to the one as shown in FIG. 1.

In the embodiment as shown in FIG. 2, however, in addition to the embodiment shown in FIG. 1 there is an acceleration sensor 40 in order to detect the acceleration on the secondary part 18. This acceleration signal is supplied to an integrator 50 which computes the speed $v_{act}$ from the acceleration $a_{act}$. It is then processed again as in FIG. 1.

In this embodiment as shown in FIG. 2, in contrast to the representation, the highpass filter 28 can also be abandoned at least in one simplified embodiment so that in this case in contrast to FIG. 2 the output of the integrator 50 is connected directly to the input of the downstream adder 31.

What is claimed is:

1. Arrangement for operating a contact roller with the following features:

a linear motor drive for position changing is assigned to the contact roller, the linear motor drive acting on the contact roller, there is furthermore a force control means for the linear motor drive, and the linear motor drive can be operated on the one hand as a damping means and on the other as a contact pressure means for producing a contact pressure force for the contact roller, there is a location sensor and/or a speed sensor and/or an acceleration sensor and/or an actual value and/or speed and/or acceleration detection and/or determination stage in order to detect and/or determine the corresponding location, the speed and/or the acceleration of a secondary part of the linear motor drive, which part can be moved relative to an at least relatively stationary primary part, the force control means is built such that an inherently definable or preselectable contact force for the contact pressure force of the contact roller with another roller which can be rolled thereon, can be modified with consideration of a force correction value which can be derived from the actual values of the position value and/or speed value and/or acceleration value of the secondary part which can be moved relative to the primary part.

2. Arrangement as claimed in claim 1, wherein the force setpoint for producing a definable contact pressure of the contact roller can be modified depending on the measured and/or determined location, speed and/or acceleration value in a comparator stage.

3. Arrangement as claimed in claim 1, wherein there is a differentiator in order to derive the actual speed for the relative speed of the movable secondary part relative to the primary part which is at least relatively stationary from the actual value of the relative position of the movable secondary part relative to the primary part (16) which is at least relatively stationary.

4. Arrangement as claimed in claim 3, wherein a filter is connected downstream of the differentiator.

5. Arrangement as claimed in claim 1, wherein there is an integrator to determine the actual speed for the relative speed of the secondary part relative to the primary part from the actual acceleration of the secondary part relative to the primary part which is at least relatively stationary.

6. Arrangement as claimed in claim 5, wherein a filters is connected downstream of the integrator.

7. Arrangement as claimed in claim 1, wherein there is an adder in which a determined actual speed can be compared to a definable setpoint speed, modified and especially added to or subtracted from one another.

8. Arrangement as claimed in claim 1, wherein there is an adder in which a determined actual speed which is filtered via a highpass filter can be compared to a definable setpoint speed, modified and especially added to or subtracted from one another.

9. Arrangement as claimed in claim 1, wherein there is a controller in which a force quantity can be produced with definable scaling.

10. Arrangement as claimed in claim 9, wherein there is an adder in which the determined force quantity is superimposed on a definable setpoint force, added or subtracted.

11. Arrangement as claimed in claim 1, wherein there is furthermore a force controller, via which the movable secondary part can be triggered at least indirectly, with consideration of a definable setpoint force, a position-dependent, speed-dependent and/or acceleration-dependent quantity of the secondary part relative to the at least relatively stationary primary part, and a quantity for the actual current which can be measured or determined in a current detection means, via which the secondary part can be moved.

12. Arrangement as claimed in claim 1, wherein there is vector control which can be triggered via the force controller and a length measurement system for determining the adjustment path of the secondary part relative to the primary part.

13. Arrangement as claimed in claim 1, wherein the linear motor drive can be triggered via a vector control.

14. Arrangement as claimed in claim 1, wherein the linear motor drive acts on the bearing points of the contact roller.

15. Arrangement as claimed in claim 1, wherein the another roller is in the form of a take-up roller or a bale.

16. Arrangement as claimed in claim 4, wherein the filter is a highpass filter.

17. Arrangement as claimed in claim 6, wherein the filter is a highpass filter.

18. Arrangement as claimed in claim 9, wherein the scaling is obtained from the difference of a definable setpoint speed and the measured or determined actual speed.

19. Process for operating a contact roller with the following features:

a contact roller with a variable position is triggered via a linear motor drive for changing its position, a force control means is used, via which the linear motor drive can be triggered on the one hand as a damping means and on the other as a contact pressure means for producing a contact pressure force for the contact roller, a location sensor and/or a speed sensor and/or an acceleration sensor and/or an actual value and/or speed and/or acceleration detection and/or determination stage is used to detect and/or to determine the corresponding location, the speed and/or the acceleration of a secondary part of the linear motor drive, which part can be moved relative to an at least relatively stationary primary part, and by the force control means an inherently definable or preselectable contact force for the contact pressure force of the contact roller with another roller which can be rolled thereon, is modified with consideration of a force correction value which is derived from the actual values of the position value and/or speed value and/or acceleration value of the secondary part which can be moved relative to the primary part.

20. Process as claimed in claim 19, wherein a force setpoint for producing a preselectable contact pressure of the contact roller is modified depending on the measured and/or determined location, speed and/or acceleration value in a comparator stage.

21. Process as claimed in claim 19, wherein a differentiator is used to derive the actual speed for the relative speed of the movable secondary part relative to the primary part which is at least relatively stationary from the actual value of the relative position of the movable secondary part relative to the primary part which is at least relatively stationary.

22. Process as claimed in claim 19, wherein the another roller includes a take-up roller or a bale.

* * * * *